US006511237B1

(12) United States Patent
Fujiwara

(10) Patent No.: US 6,511,237 B1
(45) Date of Patent: Jan. 28, 2003

(54) PRINTER ASSEMBLY AND PRINTER

(75) Inventor: Hitoshi Fujiwara, Nagano (JP)

(73) Assignee: F&F Limited, Nagano (JP)

( * ) Notice: Subject to any disclaimer, the term of this patent is extended or adjusted under 35 U.S.C. 154(b) by 100 days.

(21) Appl. No.: 09/628,033

(22) Filed: Jul. 27, 2000

(30) Foreign Application Priority Data

Jul. 27, 1999 (JP) ..... 11-212424

(51) Int. Cl.[7] ..... B41J 11/20
(52) U.S. Cl. ..... 400/58; 400/56
(58) Field of Search ..... 101/93.41, 93.37; 400/55–58, 120.16, 120.17; 347/197, 198, 220, 222

(56) References Cited

U.S. PATENT DOCUMENTS 5,014,073 A * 5/1991 Sone et al. ..... 347/198
5,570,959 A 11/1996 Moriwaki et al. ..... 400/56
5,803,633 A 9/1998 Akahane et al. ..... 400/642
6,171,001 B1 * 1/2001 Nonaka ..... 400/58

FOREIGN PATENT DOCUMENTS

JP 61 005968 A 6/1984
JP 03 190768 A 12/1989

OTHER PUBLICATIONS

Communication from EPO dated Mar. 6, 2001 forwarding European Search Report (3 pages).

* cited by examiner

*Primary Examiner*—John S. Hilten
*Assistant Examiner*—Minh H Chau
(74) *Attorney, Agent, or Firm*—Blank Rome Comisky & McCauley, LLP

(57) ABSTRACT

The printer and the printer assembly of the present invention has a line thermal head extending in the paper width direction; a non-roller type platen disposed so as to face the line thermal head for printing a thermal paper between the line thermal head and the platen; and a paper extracting device disposed on the paper ejection side of the line thermal head and the platen for feeding a thermal paper between a first and a second roller. The non-roller type platen can press the thermal paper with uniform pressure and without distortion even if it is thin. Moreover, it is possible to prevent distortion of the rollers of the extracting device even with small diameters by supporting middle parts of each shaft of respective rollers. Therefore, a thin and compact printer assemblies and printers are provided.

12 Claims, 5 Drawing Sheets

(a)

(b)

(a)

(b)

PRINTER ASSEMBLY AND PRINTER

BACKGROUND OF THE INVENTION

1. Field of the Invention

The present invention relates to a printer assembly and a printer for printing on a thermal paper of sheet.

2. Description of the Related Art

Computers are used for many applications, and along with the development of them, various types of printer are required as a peripheral device for output. Conventionally, when the computer was large and could not be moved, printers were large for having a fast processing speed. On the contrary, as personal computers such as a desktop type or the like become popular, printers become small, and desktop size printers have become popular.

Recently, various types of computers have been developed and used. Portable type computers are also developed such as a notebook type to a portable or mobile type such as PDA, that has a size easily put in a pocket. Moreover, as the Internet becomes popular, applications of the computer are widespread in various fields such as information service and communication, and the variation of users are so wide from a specialist to a general user. It is considered that as the population of users increases in the future, computers will be used in daily life in ordinary homes. In addition, the applications of computers are advancing in the direction of handling daily works with a computer at home, such as computerized account settlement, electronic commerce.

As the applications of the computer and the population of users expand, development of a printer for the various users is desired. There is an opinion that the usefulness of prints has decreased as the information and communication are computerized, however, there is a demand at all times for outputting the information obtained by a computer, history of communication and reports of account settlement in the form of printout for confirmation and for storing it temporarily. Moreover, printers being able to connect to portable phones will be required.

As the computer or other mobile equipments increase, it is desired that a printout can be available at any time when desired. Moreover, in a case where a computer is used for daily work such as electronic commerce/transactions or the like, the quantity of information to be printed out is small, and the frequency of using a printer may be low. For such a user, it will be important that the expense for buying a printer is small, and it will be an important factor that a space for installing a printer is not necessary or very small. Demand for a small and lightweight printer is so large among the users of a portable-type computer such as PDA or the portable phone.

Therefore, it is certain that one style desired as a future printer will be thin, compact, lightweight and low-cost. A printer for printing on a thermal (thermosensitive) paper using a thermal head does not require an ink nor ribbon, hence the printing mechanism can be made compact. In particular, a line thermal printer having line thermal head that is a thermal head extending in the paper width direction (in the scanning direction or the line direction), can be made very compact, since a mechanism for moving the thermal head in the scanning direction is not necessary. Hence it is suitable for the above-described demand.

However, in order to realize a printer having a thickness of about 10 mm or less, a mechanism for pushing a printing paper against the thermal head becomes a big problem.

Conventionally, a thermal paper is pressed between the thermal head and a platen roller, and the platen roller is rotated. Therefore, the thermal paper is fed while being pressed against the thermal head. To realize a thin printer, it is necessary to reduce the diameter of the platen roller, but if the diameter of the platen roller is made small, the contact area becomes insufficient. Therefore, in order to push or press the printing paper against the thermal head with a predetermined force, it is necessary to press the platen roller with a stronger force. However, if the diameter of the platen roller is made 10 mm or less, the strength of the platen roller becomes insufficient, hence if a pushing force or pressure is increased, distortion or bend is likely to occur.

Moreover, if the diameter of the platen roller becomes 5 mm or less, distortion occurs, hence the platen roller cannot push the printing paper against the thermal head with a uniform force. In particular, when the printer is a line thermal printer, if a force for pressing the thermal paper against the line thermal head differs in the paper width direction, or if a pressure is partly insufficient, the printing quality is deteriorated, and printing becomes impossible.

Such distortion or bend of the roller may be prevented if the roller is divided in the longitudinal direction to expose a shaft of roller and the exposed parts of the shaft are supported by a plurality of bearings. In the case of a platen roller, however, since it is necessary to apply a uniform pressure in the scanning direction, that is longitudinal direction of the roller, the roller cannot be divided in the longitudinal direction. Hence, the above solution cannot be adapted to the platen roller. It is also possible to support a platen roller (rotating body) by several sub rollers disposed in the longitudinal direction to prevent bending or distortion of the platen roller. However, additional thickness is required for installing the sub rollers, hence the second solution is not adaptable to a thin printer.

Under such circumstances, the present inventor has developed a technology for realizing a card-type thermal printer having a thickness of 5 mm or less. As a result, a technology that can clear the above-described problems relating to the platen roller has been developed and a very thin printer having a high printing quality becomes possible.

That is to say, it is an object of the present invention to provide a printing mechanism, that is, a printer assembly, that can reduce the thickness of a line thermal type printer about 10 mm or less, preferably, about 5 mm or less. A further object is to provide a printer having a thickness of 10 mm or less, preferably about 5 mm or less.

SUMMARY OF THE INVENTION

A printer assembly of the present invention, a stationary type platen, that is, a platen or a pressure plate-type platen that does not rotate like a roller is used for pressing a printing paper against a thermal head. In addition, a paper feed or extracting device is provided on the paper ejection side of the non-roller type platen for extracting or pulling the printing paper. The printer assembly of the present invention has a line thermal head extending in the paper width direction, a non-roller type platen disposed so as to face the line thermal head for pressing a thermal paper between the line thermal head and the platen, and a paper extracting device disposed on a paper ejection side of the line thermal head (hereinafter sometimes referred to as "thermal head") and the platen, the paper extracting device having first and second rollers for extracting the thermal paper between the first and second rollers.

As the non-roller type, it is desired to have a section of a shape tapered toward the thermal head, not a circular shape, such as a semi-circular shape or a trapezoidal shape with the thermal head side becoming narrow. The one side of such shape of platen can be supported easily by a housing or the like, and the other side is pushed against the thermal head. Therefore, adopting an elastic body having the section of above as the platen, reliably apply a predetermined force for pressure to the printing paper. In addition, it is preferable that at least a portion facing the line thermal head is covered with a covering material having a low coefficient of friction, for example, a fluoro resin type material such as Teflon (trademark). By the platen of this invention, a force for pressing the thermal paper against the thermal head can be obtained and the frictional resistance at the time of paper feed can be made small even with the non-roller type platen.

The platen having a plate or a keep plate with a surface having a small coefficient of friction and facing the line thermal head, and an elastic member for pressing the plate in the direction of the line thermal head can press the thermal paper against the thermal head as described above while reducing a frictional force at the time of paper feed.

With such a kind of non-roller type platen, some supporting frame, member or the housing can support the entire platen extending in the paper width direction. Therefore, even if the sectional area of the platen itself is not so large, and the platen itself does not have a high strength, distortion or bend does not occur by a strong force (pressure), or distortion becomes minimum. Hence, if there is a thin space of several millimeters or less facing the thermal head, a printing paper can be pressed with a sufficient force uniformly in the paper width direction against the thermal head by the non-roller type platen. Therefore, a printer assembly having a high printing quality can be realized, even if it is thin.

Contrary, in the paper extracting device provided on the paper ejection side of the thermal head, if a sufficient force for pulling or extracting the printing paper inserted between the thermal head and the platen can be obtained, it is not necessary to apply a uniform pressure continuously to the paper in the paper width direction. Therefore, according to the requirement to make the roller diameter 10 mm or less, particularly, 5 mm or less, a construction is adopted that the rotating body (roller) is divided into a plurality of rollers to expose the shaft, and the exposed parts of shaft located middle of the width direction are supported by a plurality of bearings between the rotating bodies. Hence, if the strength is insufficient due to the small roller diameter, the distortion of rollers in the extraction device will be prevented easily. By adopting such construction for at least one of the first and second rollers or for both rollers of the extracting device, a force for reliably feeding or extracting the paper without distortion can be obtained and the rollers can be installed in a thin space.

Therefore, according to the present invention, a printer assembly capable of pressing a printing paper against the thermal head with a sufficiently, and capable of obtaining a predetermined paper feeding force stably can be made very thin. The entire thickness of the printer assembly of this invention can be reduced to less than about 10 mm, preferably, to less than about 5 mm.

Accordingly, by combining the printer assembly of the present invention and a paper feed mechanism for feeding a thermal paper to the printer assembly, a very thin and compact printer having a thickness of less than about 10 mm, preferably, less than about 5 mm can be provided.

In addition, in the thermal type printer, since consumables such as an ink or the like is not required and the space is not necessary, it is possible to make the entire printer so thin by adopting the stationary type platen. Hence, printer having an overall thickness as thin as a card is realized.

In order to print by the printer assembly of the invention, first it is necessary to pass the tip of a printing paper between the thermal head and the platen and insert the tip of the paper between the rollers of the extracting device. It is desired to provide a first frame for supporting the thermal head, a second frame for supporting directly of indirectly the platen, and a gap forming mechanism for opening the space between the first frame and the second frame. It is possible to open (give a gap) between the thermal head and the platen by the gap forming mechanism to feed a printing paper to the extracting rollers, then to close the gap between the thermal head and the platen to press the printing paper between the thermal head and the platen to getting the high quality printout.

It is preferable that the first frame supports the first roller and the second frame supports the second roller. A gap control between the first and second rollers can be performed simultaneously by the gap forming mechanism. As the gap forming mechanism, a cam member that moves between the first frame and the second frame can be used.

In the platen having the plate pressing against the line thermal head with an elastic member, by depressing the plate or the elastic member, it is possible to make the gap between the platen and the thermal head.

When a gap is not formed by the gap forming mechanism, the force to press the thermal paper against the thermal head can be obtained by the elastic body of the platen itself or the elasticity of the elastic member. It is also possible to provide a pressing mechanism for ensuring the pressure between the thermal head and the plate also between the first and second roller of the extracting device. One of the pressing mechanisms is a spring member elastically connecting the first and second frames.

In the printer for the sheet or cut sheet type thermal paper not for the roller type thermal paper, the paper feeding mechanism comprises a pickup roller for pick up the thermal paper and a bottom plate for pressurizing the thermal paper to the pickup roller. The friction or pressing force between the pickup roller and the bottom plate may become a resistance force during the printing or feeding the paper by the extracting device. Therefore, it is preferable to apply a depressing mechanism for depressing the bottom plate when the thermal paper feeding by the extracting device. By the depressing mechanism, a phenomenon that the surface of the thermal sheet shines by the friction is prevented. If the printer assembly has the gap forming mechanism, the depressing mechanism for depressing the bottom plate linked with the gap forming mechanism is useful. The gap forming mechanism comprises a cam member for forming the gap between the platen and the line thermal head at one position and forming a gap between the pickup roller and the bottom plate at another position.

Furthermore, to prevent respective distortion of the first and second rollers by means of the first and second frames, it is desirable that the first and second rollers comprise a plurality of rotating bodies divided in the paper width direction and a shaft for connecting these rotating bodies, respectively, and the first and second frames be respectively provided with a plurality of bearings for respectively supporting the shaft of the first roller and the shaft of the second roller between the rotating bodies.

DETAIL DESCRIPTION OF THE PREFERRED EMBODIMENTS

Figure 1:
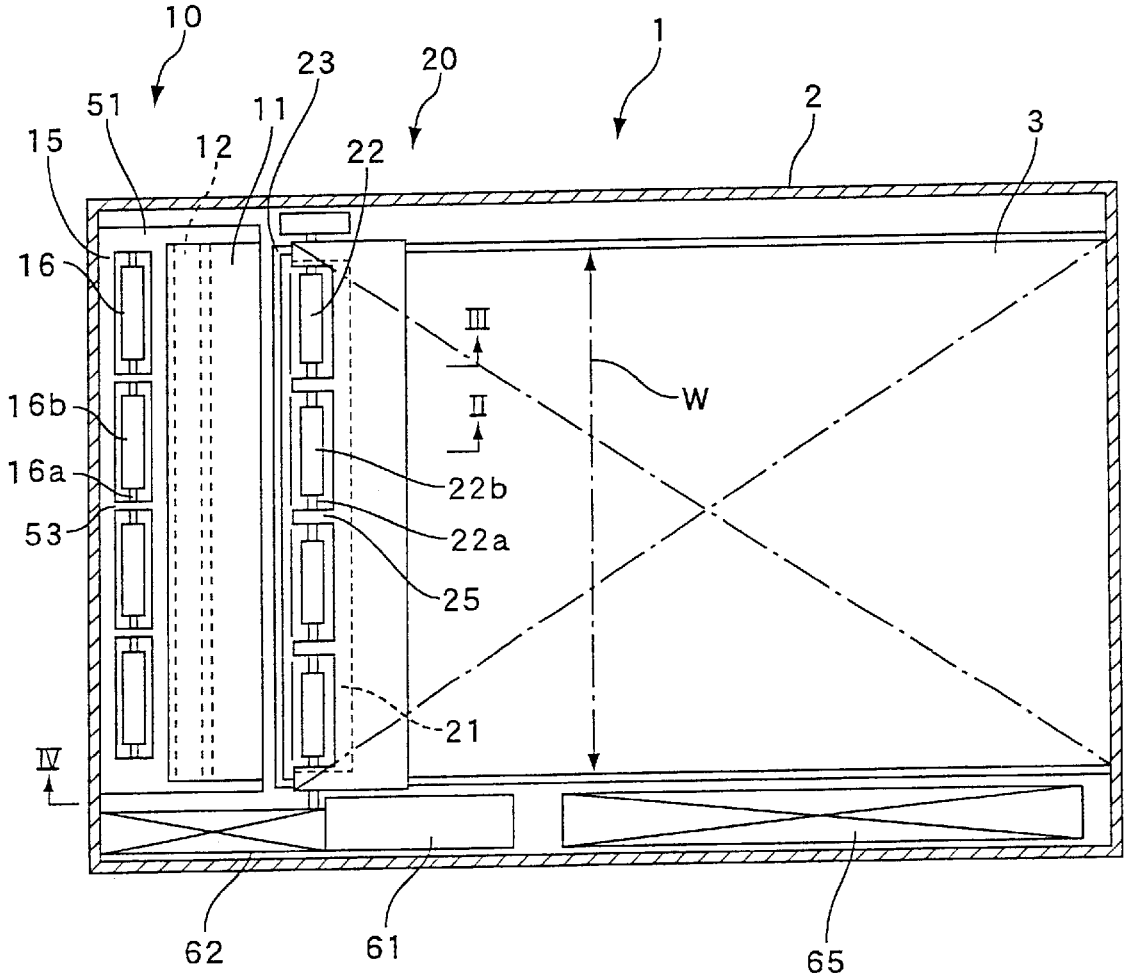
FIG. 1 shows a plane arrangement of a printer according to the present invention.
Figure 2:
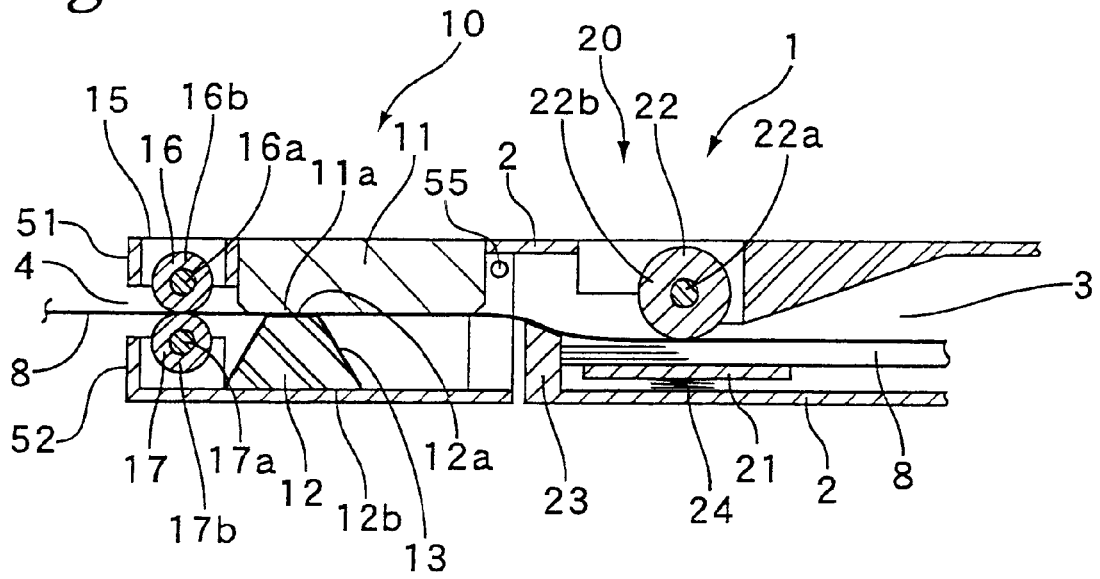
FIG. 2 is a sectional view showing a structure of a printer assembly of the printer shown in FIG. 1 on an enlarged scale, and is a sectional view showing a construction of a portion of a rotating body.
Figure 3:
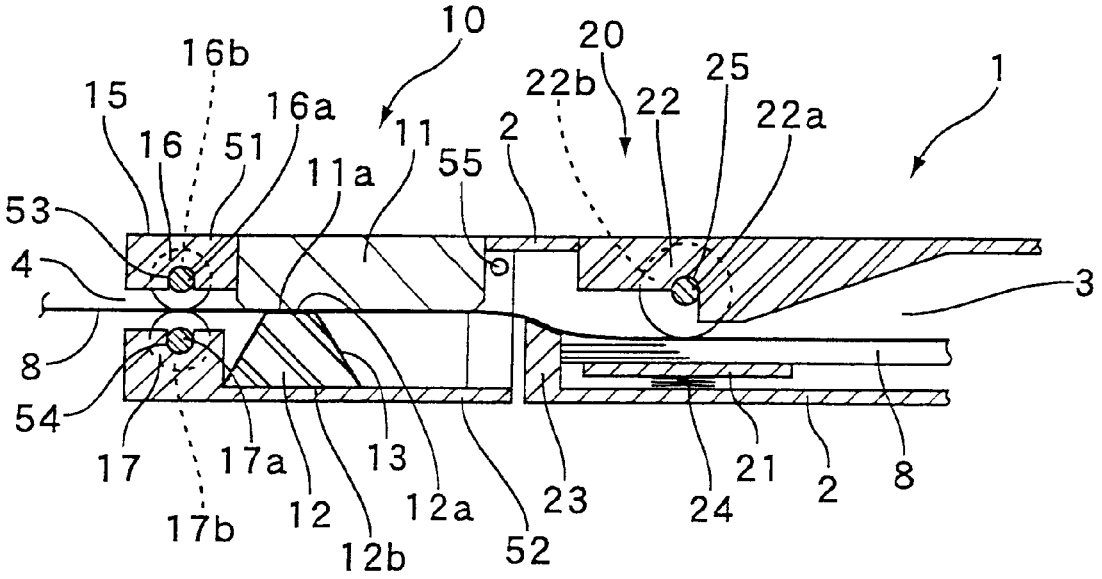
FIG. 3 is a sectional view showing a structure of a printer assembly of the printer shown in FIG. 1 on an enlarged scale, and is a sectional view showing a construction of a shaft portion.

Description of an embodiment of the present invention will be given with reference to accompanying drawings. FIG. 1 shows a plane construction of a printer 1 according to the present invention. In addition, FIG. 2 and FIG. 3 show a section of a printing mechanism (printer assembly) 10 and a paper feed mechanism 20 of the printer 1 on an enlarged scale. The printer 1 of this embodiment is in an overall rectangular shape of A7 size (74 mm×105 mm), and is a portable type printer housed in a housing 2 having a thickness of about 5 mm, which is like a thin card as a whole. Within the housing 2, a space 3 for accommodating a thermal (thermosensible) type cut sheet of an A8 size (52 mm×74 mm) is provided, and from this accommodation space 3, a cut sheet 8 is supplied to the printer assembly 10 one by one by means of a paper feed mechanism 20, and a printed paper is output from a paper ejection port 4 on the opposite side.

As shown in FIG. 2 and FIG. 3, the paper feed mechanism 20 is provided with a plate (bottom plate) 21 arranged so as to push up or press around a tip of a cut sheet 8, a pick-up roller 22 arranged so as to feed the cut sheet 8 in cooperation with the bottom plate 21, and a separation wall (separation portion) 23, against which the tip end of the cut sheet 8 fed by the pick-up roller 22 sticks and only a cut sheet located at the uppermost position (on the pick-up roller 22 side) is separated and sent to the printer assembly 10. Between the plate 21 and the housing 2, a spring 24 for forcing the plate 21 up is installed.

The printer assembly 10 for performing printing on a fed thermal paper comprises a line thermal head 11 extending over the paper width direction W, a platen 12 for pressing the thermal face of the print paper 8 against the thermal head 11, and a paper extracting device 15 for pulling the thermal paper 8 between the thermal head 11 and the platen 12 at a predetermined paper feed rate. The extracting device 15 has a first roller 16 located at the upper side in this figure and a second roller 17 located at the lower side. Then, the thermal paper 8 between these rollers 16 and 17 is fed or extracted by driving at least one of the first and second rollers 16 and 17. The printer assembly 10 of this embodiment comprises two frames located at the upper and lower positions in this figure, a first frame 51 and a second frame 52. The first frame 51 supports the thermal head 11 and the first roller 16, and the second frame 52 supports the platen 12 and the second roller 17.

The platen 12 is non-roller type and formed with a slender member extending approximately over the paper width, along the paper width direction (scanning direction, longitudinal direction or line direction) W, similar to the thermal head 11. The upper surface 12*a* of the platen 12 facing the printing face 11*a* of the thermal head 11. The back or bottom face 12*b* of the platen 12 is fixed to the frame 52 serving as a strength member of the printer assembly 10, and supported. Accordingly, even if the strength of the platen itself is not so high, the frame 52 supports the whole line direction of the platen. Hence, even if a relatively high pressure is applied between the thermal head 11 and the platen 12, distortion of the platen 12 can be prevented.

The section of this platen 12 is an approximately trapezoidal shape with the side 12*a* facing the thermal head 11 being thin or narrow, and is formed with a material having some elasticity such as hard rubber or the like. Therefore, when the platen 12 is pressed against the thermal head 11, the platen 12 somewhat deforms, and a force for reliably pushing or pressing the surface 12*a* against the thermal head 11 is obtained. Hence, the thermal paper 8 between the platen 12 and the thermal head 11 is pressed uniformly along the line direction W without a gap and is almost perfectly stuck on the printing face 11*a* of the thermal head 11. Moreover, when being pressed, the side of the platen 12 is made to deform a little, the platen 12 absorbs the assembly error of the printer assembly 10, warping of the thermal head 11 or distortion due to the temperature difference. Hence, sufficient pressure is applied uniformly in the line direction, without applying a big load to the thermal head 11. In order to centralize a force for pressure to some extent on the surface 12*a* of the platen, the platen having a shape slightly tapered toward the thermal head 11. A semi-circular shape and others are also useful, in addition to the trapezoidal shape.

The surface of this platen 12, in particular, the surface 12*a* facing the thermal head 11 is coated with a material (covering material) 13 having a low coefficient of friction such as fluororesin, for example Teflon (trademark). The platen 12 in this embodiment is a non-roller type and stationary which does not rotate in the paper feed direction, differing from a platen roller, however, the frictional force between the platen 12 and the thermal paper 8 becomes minimum. Hence, the thermal paper 8 can be fed more smoothly.

An apparatus 15 for feeding the thermal paper 8 on the paper ejection side of the thermal head 11 and the platen 12 comprises the upper and lower (first and second) rollers 16 and 17, as described above. The upper roller 16 comprises a shaft 16*a* having a diameter of about 1 mm, which extends in the paper width direction, and four rotating bodies 16*b* connected by the shaft 16*a*. These rotating bodies 16*b* has a diameter of about 2 mm, and has approximately the same length. Similarly, the lower 17 comprises a shaft 17*a* having a diameter of about 1 mm, which extends in the paper width direction, and four rotating bodies 17*b* connected by the shaft 17 and having a diameter of about 2 mm. These rotating bodies 16*b* and 17*b* are arranged, as shown in FIG. 1, dispersed at approximately a constant pitch in the paper width direction, and can press the thermal paper 8 between the rotating bodies 16*b* and 17*b* over the width by supporting of a plurality of bearings 53 and 54 respectively without distortion nor bending of shafts. Namely, the shafts 16*a* and 17*a* exposed between the rotating bodies 16*b* and 17*b* are respectively supported by a plurality of bearings 53 extending from the upper (first) frame 51, and a plurality of bearings 54 extending from the lower (second) frame 52. Therefore, as shown in FIG. 1 and FIG. 3, the first and second rollers 16 and 17 are in a state that respective shafts 16*a* and 17*a* are supported not only at the opposite ends but also in the middle parts in the paper width direction W. Accordingly, both rollers 16 and 17 have such a construction that they are hardly distorted even if a force is applied. Hence, even if a high pressure is applied to both rollers 16 and 17 by the frames 51 and 52, both rollers 16 and 17 are not distorted, and transmit the pressure over the paper width, though not continuously, to thereby generate a sufficient pulling force.

Therefore, this paper extracting device 15 applies a sufficient pressure by means of very thin rollers. Because even if the rollers are thin and the contact area with the thermal paper 8 is decreased, a sufficient pressing force is adopted for getting enough frictional force for feeding the paper. Hence, this paper extracting device 15 is so reduced size to be able to dispose in the space having a thickness of about 5 mm or less and has enough power to pull the thermal paper 8 reliably.

In this printer 1, a similar construction is adopted for the pick-up roller 22 of the paper feed mechanism 20. The pick-up roller 22 has a plurality of rotating bodies 22*b* having a diameter of about 2 mm connected by a shaft 22*a* having a diameter of about 1 mm. The shaft 22*a* is supported by a plurality of bearings 25 extending from the housing 2 between the rotating bodies 22*b*.

Conventionally, to prevent distortion of this kind of roller, diameters of rollers are increased for increasing the strength and diameters about 10 mm or more is necessary to get enough strength. Also, pressing the middle parts of the rollers by some sub rollers prevents distortions of rollers, but since the certain thickness is required for installing the sub rollers therefore a thin printer cannot be realized. On the contrary, as in the rollers adopted for the printer 1 in this embodiment, a roller body (rotating body) is divided into a plurality of parts, and the middle parts of the shaft are supported by a plurality bearings (shaft support), so a mechanism for supporting a shaft is arranged in the thickness of the roller and enabling prevention of bending of the shaft. Therefore, a strength for receiving all the pressure by means of at the ends of roller or shaft is not necessary, and the diameter of the roller can be made small, such as about 10 mm or less, preferably, about 5 mm or less, while preventing distortion. In this printer 1, by adopting this construction for the pick-up roller 22 and the first and second rollers 16 and 17 to provide the printer assembly 10 and a printer 1 having a high reliability by ensuring a stable paper feeding force, even if the printer assembly 10 and printer 1 is very thin, for example, having a thickness of about 5 mm.

As shown in FIG. 1, in the housing 2 of the printer 1 of this embodiment, a motor 61 for driving the pick-up roller 22 and the printer assembly 10 including the paper extracting device 15, and a power transmission mechanism 62 are accommodated, and a space 65 for a battery or a power source for the motor 61 is also prepared. The printer 1 of this embodiment is provided with all other functions (not shown) required as a printer, such as an interface communicating with a host device like a personal computer, a PDA to receive data for printing, a control function for controlling the motor 61 for printing the data received, and the like. Accordingly, when the printer 1 of this embodiment is carried together with a portable terminal such as the PDA, desired data can be printed out easily at any time and any place on demanded.

The printer assembly 10 of this printer 1 adopts a construction having a line thermal head 11, a non-roller platen 12 and a paper extracting device 15 for pulling the thermal paper, therefore the printer assembly 10 is very thin and obtains a stable printing quality. Since the entire part of thin platen 12 is supported by the frame or the housing due to the platen 12 does not rotate. Namely, even if the platen 12 is made thin, a problem such as distortion or the like does not occur, and the uniform pressing force along the paper width direction is improved.

On the other hand, the paper extracting device 15 can pull the thermal paper by applying a pressure intermittently over the paper width, hence, the shaft of the roller is supported at the halfway places or middle places to prevent the deformation. So, in this printer assembly 10, by separating functions of the conventional platen roller into the non roller type stationary platen 12 and the paper extracting device 15, then combining the non-roller type platen 12 and the extraction device. Therefore, a portion where the thermal head and the platen are combined and a portion of the paper feed roller can be made very thin, respectively, enabling to realize a thin and compact printer assembly 10 as a whole.

Figure 4:
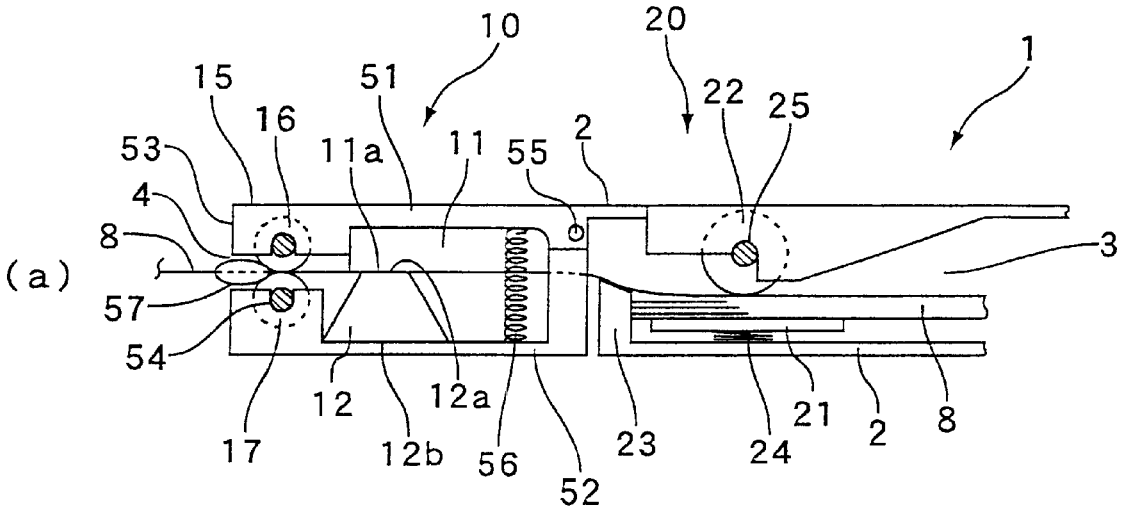
FIG. 4 is a diagram showing the insertion of a cut sheet into a printer assembly of the printer shown in FIG. 1, and FIG. 4(*a*) shows a condition where the upper and lower frames are closed, and FIG. 4(*b*) shows a condition where the upper and lower frames are opened.
Figure 4:
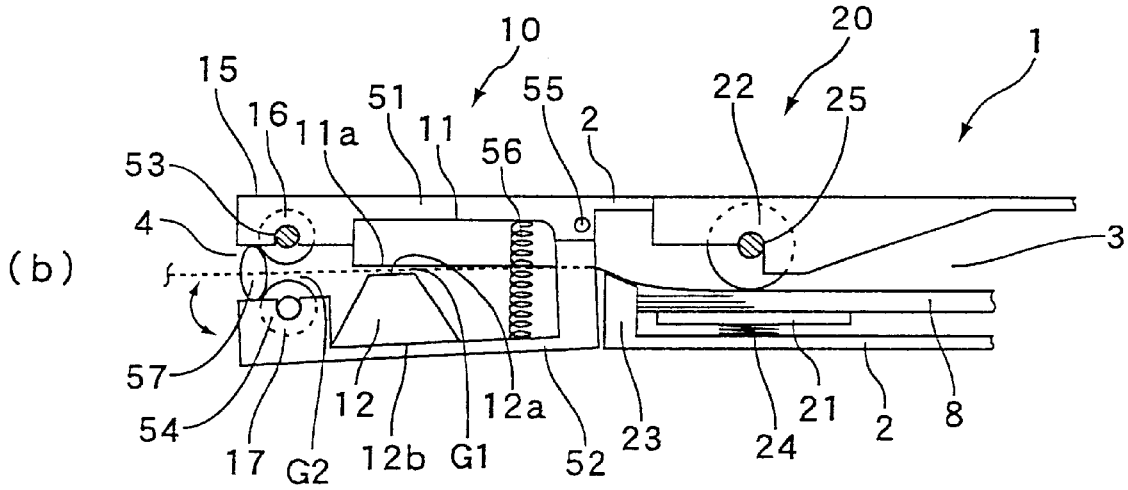

The platen 12 of this printer assembly 10 is not drive the paper, hence the thermal paper 8 cannot be pulled in between the platen 12 and the thermal head 11 by means of the platen 12 itself Therefore, as shown in FIG. 4, the upper frame 51 and lower frame 52 open and close to guide the thermal paper 8 between the thermal head 11 and the platen 12. The upper frame 51 and lower frame 52 are connected at a point 55 on the paper feed side to swing or circle each other. In addition, a spring 56 as a pressing mechanism is provided so hat these frames are pulled against each other. The platen 12 attached to the lower frame 52 is pushed against the thermal head 11 attached to the upper frame 51, therefore, the thermal paper 8 contacts with the thermal head 11 with a predetermined force (pressure) between the platen and thermal head. Similarly, the second (lower) roller 17 supported by the lower frame 52 via the bearings 54 is pressed against the first (upper) roller 16 supported by the upper frame 51 via the bearings 53, therefore, a pressure necessary for the paper feed is ensured.

It can be considered that the pressing mechanism performs a function of holding the first and second frames 51 and 52 in a predetermined positional relationship. Then, the platen 12 in this embodiment presses the thermal paper 8 against the thermal head 11 with a predetermined force, since the platen 12 is an elastic body, when the first and second frames are held at a predetermined position.

A cam 57 is provided for opening closing as a gap forming mechanism and the cam 57 moves between the upper frame 51 and lower frame 52 in the vicinity of the paper ejection port 4. The cam 57 is elliptic and can control the rotation degree by the motor 61. As 15 shown in FIG. 4(*a*), if the major axis of the cam 57 is horizontal or along the paper feeding direction, the cam 57 does not touch the upper and lower frames 51 and 52. On the contrary, as shown in FIG. 4(*b*), if the cam 57 is turned until the major axis becomes vertical or perpendicular to the feeding direction, the ends of the cam 57 touch the upper and lower frames 51 and 52, and creates the gap between the upper and lower frames 51 and 52 against the force of the spring 56. Thereby, the gap G1 is opened between the thermal head 11 and the platen 12, and the gap G2 is opened between the upper and lower rollers 16 and 17. In this state, if the thermal paper 8 is supplied by the pick-up roller 22, the thermal paper 8 is smoothly set between the thermal head 11 and the platen 12, though the platen 12 does not rotate. At the same time, the tip of the thermal paper 8 is set to the paper extracting device 15. Thereafter, if the cam 57 is turned by 90 degrees, the upper and lower frames 51 and 52 come off from the cam 57, and the upper and lower frames 51 and 52 are pulled toward each other by means of the spring 56 serving as the pressing mechanism. Accordingly, as shown in FIG. 4(*a*), the thermal paper 8 is inserted between the thermal head 11 and the platen 12, and further between the upper and lower rollers 16 and 17 of the paper extracting device 15, to thereby be ready for starting printing.

Since at least one of the upper and lower rollers 16 and 17 of the paper extracting device 15 are rotate by the motor 61, the thermal paper 8 can be guided to between these rollers 16 and 17 without having a gap G2 between the upper and lower rollers 16 and 17. Accordingly, the rollers 16 and 17 do not have to be open in connection with the frames 51 and 52.

As described above, the printer assembly 10 in this embodiment can be made very thin and compact as a whole, because it is a thermal type which does not require a space for housing consumables such as an ink or the like, and the non-roller type platen 12 is adopted. By adopting this printer assembly 10, a printer having a very small thickness like a CD case or a floppy disk case can be realized. By opening/closing the upper and lower (first and second) frames 51 and 52 of the printer assembly 10, the thermal paper 8 is smoothly guided to between the stationary platen 12 and the thermal head 11, enabling to prevent occurrence of paper jam or the like.

By the non-roller type platen 12, the thermal paper 8 is pressed almost uniformly along the paper width direction with a sufficient predetermined pressure, and by the paper extracting device 15 the thermal paper 8 passes through the thermal head 11 at a predetermined speed. Hence, a printer of the very thin type having a thickness of about 5 mm is realized and this printer 1 output a printout having a quality similar to or better than that of a conventional thermal printer using a platen roller can be provided.

Furthermore, in this printer assembly 10, since a non-roller type platen has a simple construction instead of a platen roller, it is possible to reduce the production cost, and the ultra-thin type printer can be provided at a low cost. Accordingly, the printer in this embodiment will be easily purchased and stored anywhere, such as a pocket, a handbag, a drawer of a desk or the like, and is carried easily together with a portable terminal such as PDA or the portable phone. Moreover, this thin printer can be integrated with PDA or the portable phone and total size of the portable terminal does not change greatly. Therefore, the printer of this invention is used easily anywhere at any time. Furthermore, this printer 1 prints out on a cut sheet that is easily handling rather than roll type thermal paper. It is a very convenient printer even for a user who does not use a printer often, so every one carries without stress and uses anywhere at anytime as required.

Figure 5:
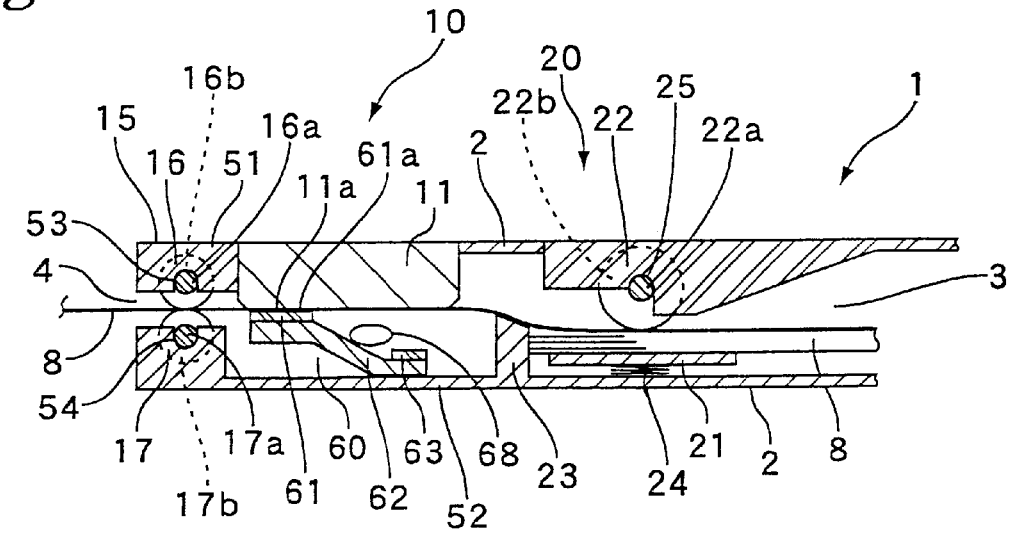
FIG. 5 is a sectional view showing an another printer assembly different from the above described printer assembly, and FIG. 5(*a*) shows a condition where a platen plate is attached to a line head, and FIG. 5(*b*) shows a condition where the platen plate is away from the line head.
Figure 5:
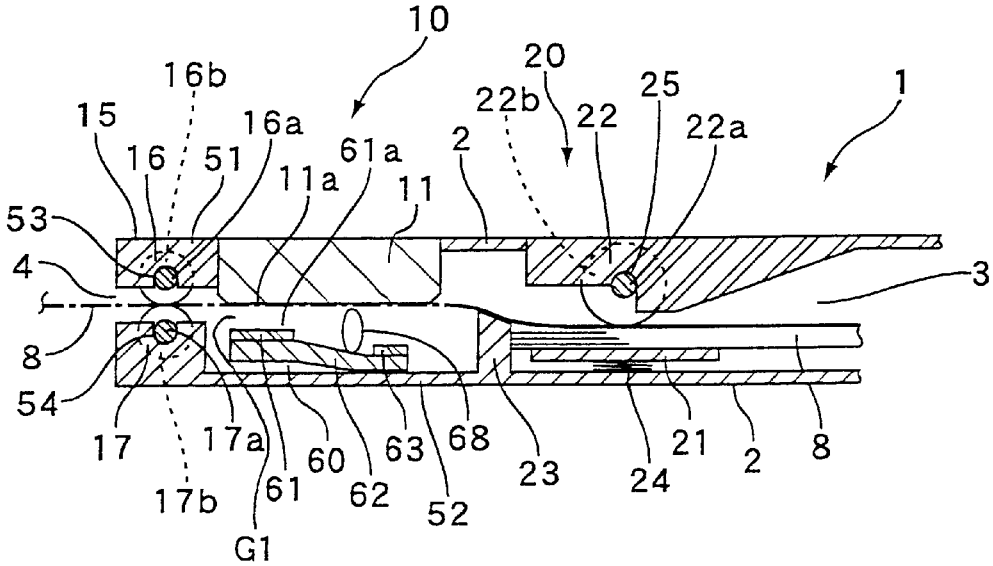

FIG. 5 shows another printer assembly different from the above described printer assembly. The printer assembly 10 in this embodiment comprises a non-roller type platen 60 having a different structure but some other parts are approximately the same with those of the above described printer assembly 10, hence the description thereof is omitted. The present printer assembly 10 has non-roller type platen 60 comprising a plate (platen plate) 61 with at least the surface 61 a being covered with a fluororesin type material such as Teflon (trademark), and a leaf spring 62 as an elastic member for pressing the platen plate 61 against the line thermal head 11. The leaf spring 62 is secured to a lower frame 52 constituting a housing 2 by means of a screw 63 or the like. The plate 61 extends in the longitudinal direction (scanning direction or paper width direction) along the printing face 11*a* of the line thermal head 11, and a thermal paper 8 is pressed between the plate 61 and the line thermal 10 head 11. In this printer assembly 10, the plate 61 continuous in the longitudinal direction against the leaf spring 62, which is continuous or interrupted in the longitudinal direction, as shown in FIG. 5(*a*), the thermal paper 8 can be pressed uniformly in a narrow or thin space, as in the above described stationary type platen.

The elastic member for pressing the plate 61 may be a leaf spring continuous in the paper width direction as in this embodiment, or a leaf spring may be disposed intermittently in the paper width direction. It is also possible to press the plate 61 by juxtaposing coil springs in the paper width direction. When the keep plate 61 is pressed by a continuous elastic body such as hard rubber, the platen of this printer assemble is approximately the same construction as that of the above-described printer assembly.

In this printer assembly 10, it is preferable to provide the gap G1 for guiding the thermal paper 8 between the plate 61 and the thermal head 11. An elliptic cam 68 is provided at a position where the leaf spring 62 can be depressed. As shown in FIG. 5(*b*), when the major axis of the elliptic cam 68 directed in the vertical direction, the cam 68 depress the spring 62 and the gap G1 is formed between the plate 61 and the thermal head 11. As a result, it becomes possible to pass the thermal paper through this gap.

In this printer assembly, the space between the first and second frames 51 and 52 may be controlled as in the above embodiment in order to form the gap. However, it is difficult to form a gap without expanding the space between the frames 51 and 52 more than a stroke of the leaf spring 62. Therefore, it is desirable to provide the gap by operating the leaf spring 62 as in this embodiment or by operating the platen plate 61. It is also possible to provide a stopper for restricting the stroke of the leaf spring 62 on the frame 52, so as to restrict the movement of the leaf spring 62 when open the frame 52 to make the gap.

Figure 6:
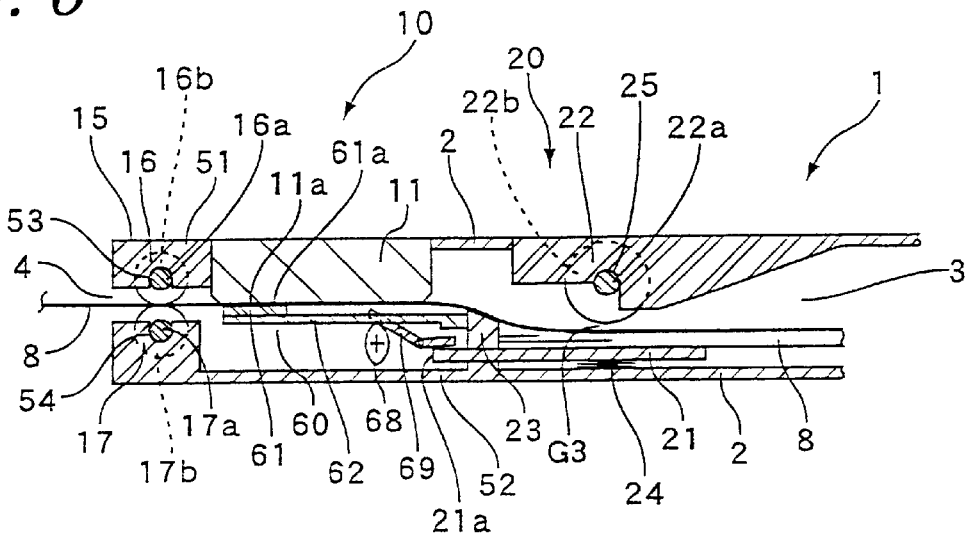
FIG. 6 is a sectional view showing an another printer assembly different from the above described printer assemblies, and FIG. 6(*a*) shows a condition where a platen plate is attached to a line head, and FIG. 6(*b*) shows a condition where the platen plate is away from the line head.
Figure 6:
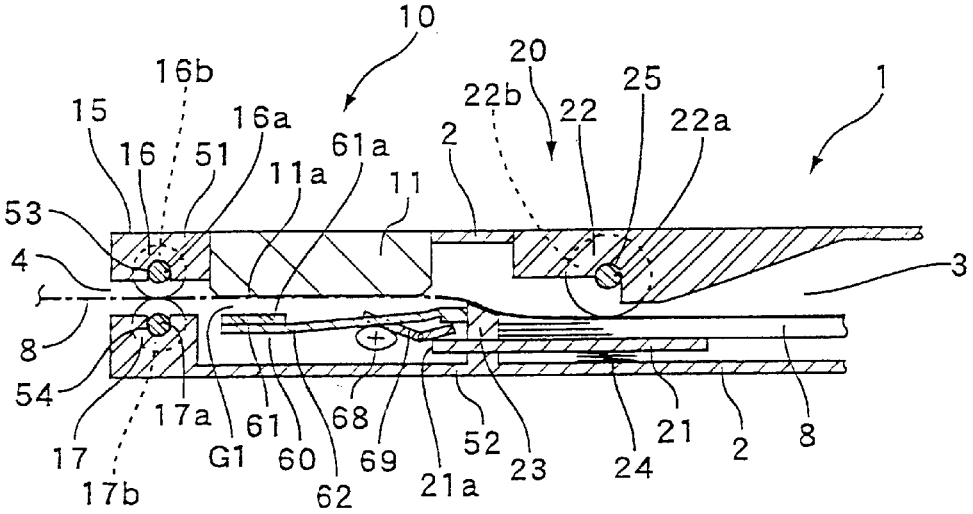

FIG. 6 shows another printer assembly different from the above described printer assemblies. The printer assembly 10 in this embodiment comprises a non-roller type platen 60 having almost the same structure of the above described printer assembly 10. The present printer assembly 10 has non-roller type platen 60 comprising a plate (platen plate) 61 with at least the surface 61*a* being covered with a fluororesin type material, and a leaf spring 62 as an elastic member for pressing the platen plate 61 against the line thermal head 11. The leaf spring 62 is secured to the upper part such as the wall 23 and pressed by a cam member 68, which is as shown in FIG. 6(*a*). The cam member 68 is a gap forming mechanism which depresses the plate 61 as shown in FIG. 6(*b*) to form a gap between the platen 60 and the line thermal head 11.

This printer 1 also has a link 69 as a depressing mechanism for depressing the bottom plate 21 linked with the cam member 68. The link member 69 is disposed between the cam member 68 and the bottom plate 21. The one end of link member 69 is attached to the cam member 68 and the other end of link member 69 is attached to the arm 21*a* extending the bottom plate 21 through the wall 23. As shown in FIG. 6(*a*), when the cam 68 is vertical position, the cam 68 presses the platen plate 61 to the thermal head 11 and actuates the link member 69 to depress the bottom plate 21 to make a gap G3 between the pick-up roller 22 and the thermal sheet 8. On the other hand, as shown in FIG. 6(*b*), when the cam member 68 is horizontal, it depresses the platen plate 61 and frees the link member 69 so as to the bottom plate 21 presses the thermal sheets to the pickup roller 22.

Since this printer 1 is for the sheet or cut sheet type thermal paper not for the roll type thermal paper, the paper feeding mechanism 20 comprises the pickup roller 22 for pick up the thermal paper 8 and the bottom plate 21 for pressurizing the thermal paper to the pickup roller 22. The friction or pressing force between the pickup roller 22 and the bottom plate 21 may become a resistance force during the printing or feeding the paper 8 by the extracting device 15. In addition, due to the friction force during the printing between the pickup roller 22 and the bottom plate 21, the surface of thermal sheet becomes shine that affects a quality of printed sheet.

In this printer 1, during the printing, the bottom plate 21 was depressed and the upper part of the thermal paper 8 becomes free from the pickup roller 21. Therefore, during the printing, the thermal sheet 8 is fed by the extracting device 15 without resistance force of pickup roller 21. So, the power of the motor 61 required to drive the rollers 16 and 17 is reduced and the motor 61 becomes compact which reduces the space for motor 61 and makes the printer 1 so compact. Further, the phenomenon that the surface of the thermal sheet becomes shine due to the friction force between the pickup roller 22 and the bottom plate 21 is prevented.

In the above, the card type compact printers having the size of A7 (74 mm×105 mm) and the like, but the size of a printer of this invention are not limited to this size. It is also possible to realize by adopting the printer assembly of the present invention, a printer of A8 size (52 mm×74 mm) or smaller. The printer assembly of this invention is also able to adapt to printers for printing paper of A4 size (240 mm×290 mm) or larger and such printers becomes small and lightweight.

The sizes of the upper and lower rollers of the paper extracting device 15 and the size of the pick-up roller are not limited to the above described value. By adopting the above described construction for these rollers, it is possible to prevent deformation of the roller and to realize a more compact printer with high reliable paper feeding function. However, as described above, the diameter of the roller having approximately 10 mm or less has the problem of distortion of the roller or insufficient contact area that affect the printing quality. When the diameter becomes approximately 5 mm or less, smooth paper feed cannot be realized unless a construction for supporting the middle parts of shaft. Therefore, the present invention is particularly effective to realize a very thin printer having a thickness of about 10 mm or less, preferably about 5 mm or less.

In the above description, respective roller is divided into four, but the roller may be divided into two or three, or five or more. In addition, the pitch of the bearing (shaft support) may not be necessarily coincided with the divided size of the roller.

Furthermore, the printers for printing on a cut sheet 8 have been described, but it is also possible to apply the present invention to a printer for printing on a roll paper. However, since the roll paper of an adequate quantity has a large diameter, the thickness of the printer depends on the thickness of accommodating roll paper. Accordingly, to realize the card-type thin printer, the printer printing on a cut sheet as is explained above are desirable.

The invention may be embodied in other specific forms without departing from the spirit or essential characteristics thereof The present embodiments are therefore to be considered in all respects as illustrative and not restrictive the scope of the invention being indicated by the appended claims rather than by the foregoing description and all changes which come within the meaning and the range of equivalency of the claims are therefore intended to be embraced therein.

What is claimed is:

1. A printer assembly, comprising:

a line thermal head extending in a paper width direction;

a non-roller type platen disposed so as to face the line thermal head for pressing a thermal paper between the line thermal head and the platen; and a paper extracting device disposed on a paper ejection side of the line thermal head and the platen, the paper extracting device having first and second rollers for extracting the thermal paper between the first and second rollers, wherein the platen comprises a plate having a surface of a small coefficient of friction, and further comprising an elastic member for pressing the plate in the direction of the line thermal head; and a gap forming mechanism which depresses the plate of the platen or the elastic member for supporting the plate, to form a gap between the platen and the line thermal head.

2. A printer assembly according to claim 1, wherein at least one of the first and second rollers comprises a plurality of rotating bodies divided in the paper width direction, a shaft for connecting these rotating bodies, and a plurality of bearings for supporting the shaft between the rotating bodies.

3. A printer assembly according to claim 1, wherein the platen comprises an elastic body having a section with a side of the line thermal head becoming narrow, and a covering material having a small coefficient of friction for covering at least a portion where the elastic body faces the line thermal head.

4. A printer assembly according to claim 1, further comprising a first frame for supporting the line thermal head, a second frame for supporting the platen, and a gap forming mechanism for opening the space between the first and second frames.

5. A printer assembly according to claim 4, wherein the first frame supports the first roller, and the second frame supports the second roller.

6. A printer having a printer assembly according to claim 1, and a paper feed mechanism for feeding the thermal paper to the printer assembly.

7. A printer according to claim 1;

a pickup roller for picking up the thermal paper;

a bottom plate for pressurizing the thermal paper to the pickup roller; and a depressing mechanism for depressing the bottom plate linked with the gap forming mechanism.

8. A printer according to claim 7, wherein the gap forming mechanism comprises a cam member for forming the gap between the platen and the line thermal head at one position and forming a gap between the pickup roller and the bottom plate at another position.

9. A printer assembly, comprising:

a line thermal head extending in a paper width direction;

a non-roller type platen disposed so as to face the line thermal head for pressing a thermal paper between the line thermal head and the platen;

a paper extracting device disposed on a paper ejection side of the line thermal head and the platen, the paper extracting device having first and second rollers for extracting the thermal paper between the first and second rollers;

a first frame for supporting the line thermal head;

a second frame for supporting the platen; and a gap forming mechanism for opening the space between the first and second frames, wherein the first frame supports the first roller, the second frame supports the second roller, and the first and second rollers comprises, respectively, a plurality of rotating bodies divided in the paper width direction, and a shaft for connecting these rotating bodies, the first frame further comprises a plurality of bearings for supporting the shaft of the first roller between the rotating bodies, and the second frame further comprises a plurality of bearings for supporting the shaft of the second roller between the rotating bodies.

10. A printer assembly, comprising:

a line thermal head extending in a paper width direction;

a non-roller type platen disposed so as to face the line thermal head for pressing a thermal paper between the line thermal head and the platen;

a paper extracting device disposed on a paper ejection side of the line thermal head and the platen, the paper extracting device having first and second rollers for extracting the thermal paper between the first and second rollers;

a first frame for supporting the line thermal head;

a second frame for supporting the platen;

a gap forming mechanism for opening the space between the first and second frames; and a pressing mechanism for elastically connecting the first and second frames.

11. A printer assembly, comprising:

a line thermal head extending in a paper width direction;

a non-roller type platen disposed so as to face the line thermal head for pressing a thermal paper between the line thermal head and the platen;

a paper extracting device disposed on a paper ejection side of the line thermal head and the platen, the paper extracting device having first and second rollers for extracting the thermal paper between the first and second rollers;

a first frame for supporting the line thermal head;

a second frame for supporting the platen; and a gap forming mechanism for opening the space between the first and second frames;

wherein the gap forming mechanism comprises a cam member moving between the first and second frames.

12. A printer comprising a printer assembly including a line thermal head extending in a paper width direction; a non-roller type platen disposed so as to face the line thermal head for pressing a thermal paper between the line thermal head and the platen; and a paper extracting device disposed on a paper ejection side of the line thermal head and the platen, the paper extracting device having first and second rollers for extracting the thermal paper between the first and second rollers, and a paper feed mechanism for feeding the thermal paper to the printer assembly, wherein the paper feeding mechanism comprises a pickup roller for pick up the thermal paper, a bottom plate for pressurizing the thermal paper to the pickup roller and a depressing mechanism for depressing the bottom plate when the thermal paper is fed by the extracting device.

* * * * *